US007695350B2

(12) United States Patent
Mase et al.

(10) Patent No.: US 7,695,350 B2
(45) Date of Patent: Apr. 13, 2010

(54) APPARATUS FOR SUPPLYING CONSTANT AMOUNT OF ABRASIVES

(75) Inventors: Keiji Mase, Tokyo (JP); Ryoji Kikuchi, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/199,164

(22) Filed: Aug. 27, 2008

(65) Prior Publication Data

US 2009/0075569 A1 Mar. 19, 2009

(30) Foreign Application Priority Data

Sep. 19, 2007 (JP) ..... 2007-243051

(51) Int. Cl.
*B07C 5/36* (2006.01)

(52) U.S. Cl. ..... 451/99; 222/169; 451/446

(58) Field of Classification Search ..... 451/38, 451/94, 95, 99, 446; 222/169
See application file for complete search history.

(56) References Cited

U.S. PATENT DOCUMENTS 6,200,203 B1 * 3/2001 Xu et al. ..... 451/99
2009/0075569 A1 * 3/2009 Mase et al. ..... 451/99

FOREIGN PATENT DOCUMENTS

JP 10249732 A 9/1988
JP 938864 A 2/1997
JP 11347946 A 12/1999

* cited by examiner

*Primary Examiner*—Timothy V Eley
(74) *Attorney, Agent, or Firm*—Porzio Bromberg & Newman, P.C.

(57) ABSTRACT

An apparatus for supplying a constant amount of abrasives that can accurately control the amount of the abrasives to be supplied to a blasting machine is provided. A horizontally rotating disc 20 is provided in an abrasive tank 10 so as to be embedded in the abrasives. An opening at one end 11*a* of an abrasive transport path 11 is formed so as to be close to or in contact with one surface of the disc 20, an opening at one end 12*a* of a supply channel 12 for transport air flow is formed so as to be close to or in contact with the other surface of the disc 20, and an abrasive retrieve section 5 is formed between the both openings. Furthermore, measuring holes 21 penetrating the disc 20 in the thickness direction are formed at regular intervals along a rotation orbit of the disc 20 passing through the retrieve section 5, and an introduction path 17 for compressed gas which is ejected to the abrasives disposed above the measuring holes 21 and outside the retrieve section 5 is provided.

13 Claims, 7 Drawing Sheets

Prior Art

Prior Art

Prior Art

APPARATUS FOR SUPPLYING CONSTANT AMOUNT OF ABRASIVES

CROSS-REFERENCE TO RELATED APPLICATION

This application claims priority on JP 2007-243051, filed Sep. 19, 2007, hereby incorporated in its entirety by reference into this application.

BACKGROUND OF THE INVENTION

1. Field of the Invention

The present invention relates to an apparatus for stably supplying a constant amount of abrasives, and more particularly, to an apparatus that is adapted to a blasting machine or a shot peening machine (hereinafter, simply referred to as a "blasting machine") for ejecting a mixed fluid composed of compressed air and the abrasives from a blasting gun provided with a nozzle so that the amount of the abrasives ejected from this blasting gun is controlled to a constant amount.

2. Description of the Related Art

In a blasting machine for ejecting the abrasives together with compressed air, any variation in the ejected amount of the abrasives results in a change in the amount to be processed, leading to variations in processing accuracy. In order to prevent these variations, there is proposed an apparatus for merging a predetermined amount of the abrasives per unit time with compressed air that is ejected from a blasting gun so that the ejected amount of the abrasives always becomes constant.

As one example of such an apparatus, a known apparatus for use with a suction blasting machine will be described with reference to FIGS. 5 and 6. Referring to FIG. 5, a known type of apparatus 1 for use with a suction blasting machine, as described above, includes in a blasting gun 40 a flow channel 41 for compressed air and a branch channel 42 branching off this flow channel 41. When high-pressure compressed air is introduced into the flow channel 41, negative pressure (suction force) generated at this time causes some abrasives to be sucked through the branch channel 42 and to be ejected together with the compressed air. This known type of apparatus 1 for use with the suction blasting machine includes a transport path 11 for the abrasives, which is a branch channel merging with the flow channel 41, an abrasive tank 10 communicating with this transport path 11, and means for transporting and supplying a constant amount of the abrasives in the tank 10 per unit time to the transport path 11.

As the means for transporting a predetermined amount of the abrasives in the tank 10 per unit time to the transport path 11, a drum 20' having a plurality of V-shaped measuring grooves 23 formed on an outer circumferential surface thereof is embedded into the abrasives in the tank 10 such that a part of the outer circumferential surface is exposed from the abrasives. The drum 20' is rotatably housed in this embedded state. Furthermore, one end 11*a* of the transport path 11 is arranged so as to face the measuring grooves 23 on the outer circumference of the drum 20' exposed from the abrasives. When the drum 20' rotates, the abrasives collected in the measuring grooves 23 is sucked into the transport path 11, merged with compressed air flowing in the flow channel 41, and is ejected from the tip of the blasting gun 40.

As a result, by controlling the rotational speed of an electric motor 30 which rotationally drives the drum 20' by the use of, for example, an inverter, the amount of ejected the abrasives can be adjusted in such a manner that the number of times that the abrasives is collected and transported per unit time follows a change in the rotational speed controlled by the inverter (refer to Japanese Unexamined Patent Publication No. H9-38864).

Referring now to FIG. 7, to adopt the apparatus for supplying a constant amount of the abrasives for use with a direct-pressure blasting machine, a drum 20' having many bottomed measuring holes 21' for measuring a constant amount of the abrasives per unit time, formed on the outer circumference thereof, is disposed in a tank 10. Then, the opening at one end 11*a*' of a transport path 11' for the abrasives is arranged to face the measuring holes 21' provided on this drum 20'. Furthermore, the other end of the transport path 11' is made to communicate with a compressed-air flow channel 41 in which compressed air to be ejected from the front-end nozzle of a blasting gun (not shown) flows. Furthermore, the transport path 11' is provided with a conduit 43 into which compressed air is introduced, so that compressed air introduced into the transport path 11' through this conduit 43 is forced into the measuring holes 21' and blows up the abrasives collected in the measuring holes 21', thereby causing the abrasives to merge with the compressed air flowing in the compressed-air flow channel 41. In this manner, a constant amount of the abrasives merged with compressed air can be ejected per unit time from the blasting gun.

As with the apparatus for the suction blasting machine, the apparatus 1 for this direct-pressure blasting machine is constructed such that the amount of the abrasives ejected from the blasting gun can be adjusted by controlling the rotational speed of a motor that drives the drum 20' by the use of, for example, an inverter (refer to Japanese Unexamined Patent Publication No. H11-347946).

For measuring holes used to measure the amount of the abrasives, there is also proposed an apparatus for allowing the abrasives to be collected via through-holes, instead of the bottomed holes described in H11-347946, formed so as to penetrate a disc in the thickness direction thereof (refer to Japanese Unexamined Patent Publication No. H10-249732).

In the known apparatus 1 with the above-described structure, as well as the apparatuses 1 described in H9-38864 and H11-347946, the amount of the abrasives is measured by means of the bottomed measuring grooves 23 or the measuring holes 21' formed on the outer circumference of the drum 20'. However, extremely high processing accuracy is required to form the measuring grooves 23 and measuring holes 21' on the entire circumference of the drum 20' such that they have a uniform height at any position. Thus, errors in formation of the measuring grooves 23 or the measuring holes 21' generated during processing directly lead to errors in the amount of the abrasives measured.

In addition, as shown in H11-347946 in particular, when the measuring holes 21' are formed as relatively deep, bottomed holes, the abrasives does not easily enter the holes, thus causing the amount of the abrasives collected in the measuring holes 21' to vary from hole to hole. What is worse is that not all amounts of the abrasives, once collected in the measuring holes 21', can be blown out even with compressed air. This makes it impossible to ensure that a constant amount of the abrasives is collected in each of the measuring holes 21' or that a constant amount of the abrasives is acquired from each of the measuring holes 21'.

In contrast, the apparatus 1 for supplying a constant amount of the abrasives described in H10-249732 includes measuring holes for measuring the amount of the abrasives in the form of through-holes that penetrate a disc-shaped member in the thickness direction thereof. In this apparatus 1, therefore, the measuring holes that are formed can be endowed with a constant depth (length) by making the thickness of the disc constant and, furthermore, can easily introduce the abrasives thereinto and blow out the abrasives therefrom compared with the above-described bottomed holes.

However, even if substantially no variation in the amount of the abrasives can be seen among the measuring holes, an insufficient amount of the abrasives may be collected in the measuring holes. Furthermore, even if a required amount of the abrasives is collected in the measuring holes, the abrasives may fall out from the measuring grooves 23 or the measuring holes 21' before the abrasives collected is transported to the transport path 11 (11'), thus failing to ensure with the above-described conventional structure that the amount of the abrasives that has reached the transport path 11 (11') is always constant.

It is proposed, also with the above-described conventional structure, that vibration be applied to the tank 10 or the drum 20' to allow the abrasives to be easily collected in, for example, the measuring grooves 23, thus preventing a situation where an insufficient amount of the abrasives enters the measuring grooves 23 or the measuring holes 21', and to allow excess the abrasives heaped above the level of the measuring grooves 23 to be shaken off (refer to H11-347946). When the tank 10 is to be vibrated in this manner, the abrasives is compressed hard and clumps together in the tank 10 depending on, for example, the material of the abrasives, which may undesirably decrease the fluidity of the abrasives.

Furthermore, when vibration is applied to the tank 10 or the drum 20' as described above, some abrasives that have been collected in the measuring grooves 23 may be shaken off. This means that applying vibration as described above does not always ensure the desired performance of supplying a constant amount of the abrasives.

In addition, in the known apparatus 1 for supplying a constant amount of the abrasives with the above-described structure, a slider 27 provided at the edge of the opening of the transport path 11' is slidably in contact with the outer circumference of the drum 20' to prevent the pressure in the transport path 11' or the flow channel 41 from leaking into the tank 10. For this reason, both the drum 20' and the slider 27 become seriously worn and need to be replaced frequently. In particular, since the above-described slider is made of relatively expensive boron material, frequent replacement of the slider leads to extremely high operating costs.

Furthermore, when the abrasives to be transported is delivered into the tank 10 and is left in a lump, the abrasives may aggregate and become hard over time. This aggregation significantly decreases the fluidity of the abrasives.

If this aggregation occurs, it becomes difficult to collect the abrasives in the measuring grooves 23 or the measuring holes 21', making it more difficult to accurately measure the amount of the abrasives. Consequently, the amount of the abrasives supplied to the blasting gun is subjected to variation.

In particular, the abrasives to be used may be an elastic abrasives produced by forming an elastic base material having abrasives grains compounded and dispersed therein into a predetermined grain size or an elastic abrasives produced by carrying, e.g., depositing abrasives grains on a surface of the elastic base material formed into a predetermined grain size. Such elastic abrasives are more easily subjected to aggregation as described above, compared with normal abrasives. Consequently, when blasting is started or resumed after the abrasives has been left in the tank for a relatively long period of time without allowing the abrasives to flow, the amount of the abrasives supplied becomes unstable or supplying the abrasives itself may become impossible in an early stage after the blasting has been started or resumed.

To prevent such failing supply of the abrasives, the following extremely time-consuming procedures need to be performed. That is, the elastic abrasives remaining in the tank of the blasting machine is completely removed when the blasting machine is to be stopped for a certain period of time, for example, at the end of the working day. Then, when the blasting machine is to be started again, the tank of the blasting machine is refilled with the abrasives before working is resumed.

The fluidity of the abrasives changes according to the grain size. Consequently, if the grain size of the abrasives is so small that relatively high fluidity is provided, the amount of the abrasives that is introduced into the tank 10 increases, thereby causing the amount of the abrasives in the tank 10 to become higher. On the other hand, to prevent this from occurring as far as possible, vibrators (not shown) are provided to apply vibration to the above-described known tank and a recovery tank (not shown). In this case, the vibrators that apply vibration to the above-described recovery tank are adjusted. This adjustment is so difficult that if adjustment causes the fluidity to decrease, the abrasive level in the tank 10 decreases. Furthermore, an aggregation phenomenon as described above may occur at the branch channel 42 (the transport path 11), causing the abrasive level to become seriously unstable.

In the above-described known apparatus for supplying a constant amount of the abrasives provided with for example, a drum that is not entirely covered or embedded with the abrasives but is partly exposed from the abrasives, the partial embedment state of the drum into the abrasives changes as the amount of the abrasives in the tank 10 changes (e.g., decreases), thereby inducing a change in the manner that the abrasives is collected in the measuring grooves 23, thereby the amount of the abrasives to be supplied is increased. For example, when the drum is disposed relatively deep in the abrasives, some abrasives may adhere around the measuring grooves 23, and such abrasives around the measuring grooves 23 may be supplied along with the abrasives in the measuring grooves 23. If this is the case, a change in the amount of the abrasives supplied will be induced according to a change in grain size of the abrasives to be supplied.

In order to overcome this problem, in the known apparatus for supplying a constant amount of the abrasives with the above-described structure, the grain size of the abrasives to be used needs to be taken into consideration to accurately control the amount of the abrasives supplied, which requires complicated adjustment.

Any apparatus for supplying a constant amount of the abrasives with the above-described conventional structure is constructed so as to arrange drums or discs for measuring the amount of the abrasives partly embedded with the abrasives and partly exposed from the abrasives as described above, so that the portions exposed from the abrasives function to recover the abrasives collected in the measuring holes or the measuring grooves. For this reason, when a constant amount of the abrasives is to be supplied to a plurality of blasting guns simultaneously, a plurality of the above-described apparatuses for supplying a constant amount of the abrasives needs to be provided according to the number of blasting guns. Alternatively, the above-described tank may be shared. In this case, however, the number of above-described drums and discs housed in the tank that need to be prepared is the same as the number of blasting guns. This increases the number of components and causes the size of the blasting machine to increase.

In view of these circumstances, the present invention is conceived to overcome problems associated with the above-described conventional techniques. A first object of the present invention is to facilitate introduction of the abrasives in measuring holes. A second object of the present invention is to make the abrasives in the measuring holes be taken out easily. A third object of the present invention is to prevent a change in the amount of the abrasives in the measuring holes while the abrasives are being moved to the transport path. Thereby, a fourth object of the present invention is to accurately transport the measured amount of the abrasives. A fifth object of the present invention is to ensure satisfactory fluidity to achieve supply of a constant amount of the abrasives that is easily subjected to aggregation as described above, for example, the above-described elastic abrasives. A sixth object of the present invention is to supply a constant amount of the abrasives irrespective of a change in the amount of the abrasives in the above-described tank 10 resulting from a change in grain size of the abrasives. A seventh object of the present invention is to provide an apparatus for supplying a constant amount of the abrasives for a blasting machine that can supply a constant amount of the abrasives to a plurality of blasting guns simultaneously.

SUMMARY OF THE INVENTION

In the following explanation of the Summary, reference numerals are referred as of the Embodiment in order to easily read the present invention, however, these numerals are not intended to restrict the invention as of the Embodiment.

Referring to relevant drawings, an apparatus 1 for supplying a constant amount of the abrasives according to the present invention (hereinafter, referred to as the apparatus of the present invention) can be applied to an apparatus having, for example, a plurality of blasting guns 40, 40'. The following description, however, focuses on an apparatus structure including one blasting gun.

To achieve the above object, an apparatus 1 of the present invention for supplying a constant amount of abrasives to a blasting gun 40 of a blasting machine that ejects a mixed fluid composed of a compressed gas and the abrasives supplied from an abrasive tank for storing the abrasives, is characterized by comprising:

a) a supply channel 12 for a transport air flow in a casing 2 of the tank, the supply channel 12 communicating with an external compressed-gas supply source;

b) a transport path 11 for the abrasives, communicating with the supply channel 12, (b-1) the transport path 11 having one end 11*a* thereof communicating with the supply channel 12 and the other end 11*b* thereof communicating with the blasting gun 40;

c) a rotating disc 20 in the casing 2, wherein (c-1) the rotating disc 20 is, preferably entirely, embedded with the abrasives stored in a space separated from the supply channel 12 and the transport path 11;

(c-2) the rotating disc 20 rotationally passes through an abrasive retrieve section 5 defined as an opening formed between the supply channel 12 and the transport path 11; and (c-3) the rotating disc 20 includes a plurality of measuring holes 21 formed at regular intervals along a circumferential direction thereof such that the plurality of measuring holes 21 pass through the disk in a thickness direction of the rotating disk, the plurality of measuring holes 21 being disposed on a rotation orbit so as to allow the supply channel 12 to communicate with the transport path 11 through the retrieve section 5 as the rotating disc 20 rotates; and d) an introduction path 17 for compressed gas passing through a bottom surface 3 of the casing 2, wherein (d-1) one end 17*a* of the introduction path 17 communicates with the compressed-gas supply source (not shown) outside the casing 2 of the tank, and (d-2) the other end of the introduction path 17 opens in a rotation orbit direction of the measuring holes 21 at a position except the retrieve section 5, which is a section including the transport path 11.

In the apparatus 1 of the above-mentioned structure, the other end 17*b* of the introduction path 17 may include an opening that faces the measuring holes 21 formed on the disc 20.

A plurality of lines (L1 to L3) of the vertically formed measuring holes 21 may be disposed concentrically along a circumferential direction of the disc 20 rotating in a horizontal direction, and a plurality of the introduction path 17 may be provided so as to correspond to the locations of the lines (L1 to L3), respectively.

Further, a plurality of sets of the transport path 11 and the supply channel 12 may be provided and the retrieve section 5 may be provided at constant rotation-angle intervals of the disc 20.

A stirring vane 22 for stirring the abrasives may extend from a top surface of the disc 20.

The blasting machine may be a direct-pressure blasting machine, and one of two ends (hereinafter referred to as "the one end 12*b*") of the supply channel 12 may be made to communicate with the compressed-gas supply source (not shown).

The abrasive tank 10 can be hermetically made to communicate with the compressed-gas supply source, and the one end 12*b* of the supply channel 12 may open in the tank 10 at a position higher than an upper limit of the abrasives-filling position.

Flanges 11*c*, 12*c* slidably in contact with the disc 20 may be provided at an opening at the one end 11*a* of the transport path 11 and an opening at the other end 12*a* of the supply channel 12.

With the structure according to the present invention described above, the apparatus 1 of the present invention can afford the following distinct advantages.

A disc 20 having measuring holes 21 formed thereon is rotated at a constant speed to fill the measuring holes 21 with the abrasives that are reserved in a space separated from a supply channel for the above-described transport air flow and a transport path for the above-described abrasives in the tank and to continuously transport the abrasives to the transport path 11, thereby making it possible to quantitatively eject the abrasives from the blasting gun 40.

In particular, if the measuring holes 21 formed on the disc 20 rotating in the horizontal direction are through-holes extending in the vertical direction, the abrasives easily flows into the measuring holes 21. Furthermore, the measuring holes 21 formed on the disc 20, which is relatively thin, are shallow, and the abrasives enters the measuring holes 21 more easily.

Moreover, since the disc 20 is, preferably entirely, embedded with the abrasives, the measuring holes 21 are always filled with the abrasives and the rotation of the disc 20 does not affect the amount of the abrasives collected in the measuring holes. As a result, a constant amount of the abrasives can always be transported to the transport path.

In addition, when the measuring holes 21 move to between the opening at one end 11*a* of the transport path 11 and the opening at the other end 12*a* of the supply channel 12 as a result of the rotation of the disc 20, the abrasives outside the measuring holes 21 is stripped off by the edge of the opening of the transport path 11 and the edge of the opening of the supply channel 12. This ensures that the amount of the abrasives to be introduced into the transport path 11 is extremely accurate.

Furthermore, the apparatus 1 of the present invention is cheap compared with a conventional structure in which a slider made of, for example, boron material is slidably in contact with another component. This leads to reduction in the operating cost.

In addition, since an introduction path 17 is provided through which a compressed gas is ejected and which has an opening at a position except a retrieve section 5 such that the opening faces a space above the locations at which the measuring holes 21 are formed, the abrasives at the above-described positions is stirred by ejecting a compressed gas to recover the fluidity of the abrasives whose fluidity has been decreased due to, for example, aggregation. This allows the measuring holes 21 of the disc 20 to be smoothly filled with the abrasives.

In this manner, since the amount of the abrasives to be transported to the transport path 11 can be accurately measured, an amount of ejected the abrasives closer to the theoretical value can be achieved, compared with the apparatus 1 having the above-described conventional structure. This makes it easy to control the amount of the abrasives to be supplied.

Because of the disc 20 being, preferably entirely, embedded with the abrasives in the tank 10, it is possible to provide an apparatus in which the amount of the abrasives to be supplied is not affected by a change in the amount of the abrasives in the tank 10 even if the amount of the abrasives in the abrasive tank 10 is increased or decreased due to a change in fluidity resulting from a change in grain size of the abrasives to be used.

With a structure in which the introduction path 17 is provided through the bottom surface of the above-described tank and an opening is provided so as to face the measuring holes 21, it is possible to accurately eject a compressed gas towards the abrasives disposed above the measuring holes 21 and cause that the abrasives to fall into the measuring holes 21.

If a plurality of lines (L1 to L3) of the measuring holes 21 are provided and an introduction path 17 is provided for each line of the measuring holes 21, the abrasives disposed on all lines (L1 to L3) of the measuring holes 21 can be stirred. This allows all lines (L1 to L3) of the measuring holes 21 to be reliably filled with the abrasives.

In addition, as described above, due to a structure in which the abrasives is collected in by the use of the measuring holes 21 of the disc 20 that horizontally rotates in the abrasives in a state that the disc is entirely embedded with the abrasives, the transport path 11 and the supply channel 12 for transport air flow can be arranged at predetermined rotation-angle intervals. As a result, it is possible to provide an apparatus that can simultaneously supply a constant amount of the abrasives to a plurality of the blasting guns 40,40' merely with the single apparatus 1 of the present invention provided with the single disc 20.

With any stirring vane 22 which extends upward and is fastened on the top surface of the disc 20, even if the abrasives is aggregated hard, the fluidity of the abrasives can be recovered by stirring and loosening the abrasives above the disc 20 using this stirring vane 22. Thereby, the abrasives can be made to fall down and suitably flow into the measuring holes 21 provided on the disc 20.

The structure of the apparatus 1 of the present invention can be applied not only to a suction blasting machine but to a direct-pressure blasting machine by changing the connection of the transport path 11 and the position of the opening or the connection at the one end 12*b* of the supply channel 12.

With a structure having flanges 11*c*, 12*c* provided around the surrounding edge of the opening at one end of the transport path 11 and the surrounding edge of the opening at the other end 12*a* of the supply channel 12, even if the hole diameter of the measuring holes 21 is made larger than the wall thickness of the abrasive transport path 11 or the supply channel 12 (e.g., the thickness of a pipe, if the transport path 11 or the supply channel 12 is formed of a pipe), the transport path 11 can be prevented from communicating with the reservoir space 13 in the tank 10 through the measuring holes 21, thus suitably preventing the abrasives from leaking.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Embodiments according to the present invention will now be described with reference to the attached drawings.

[Apparatus for Supplying a Constant Amount of the Abrasives for Use with a Suction Blasting Machine]

Overall Structure

Figure 1:
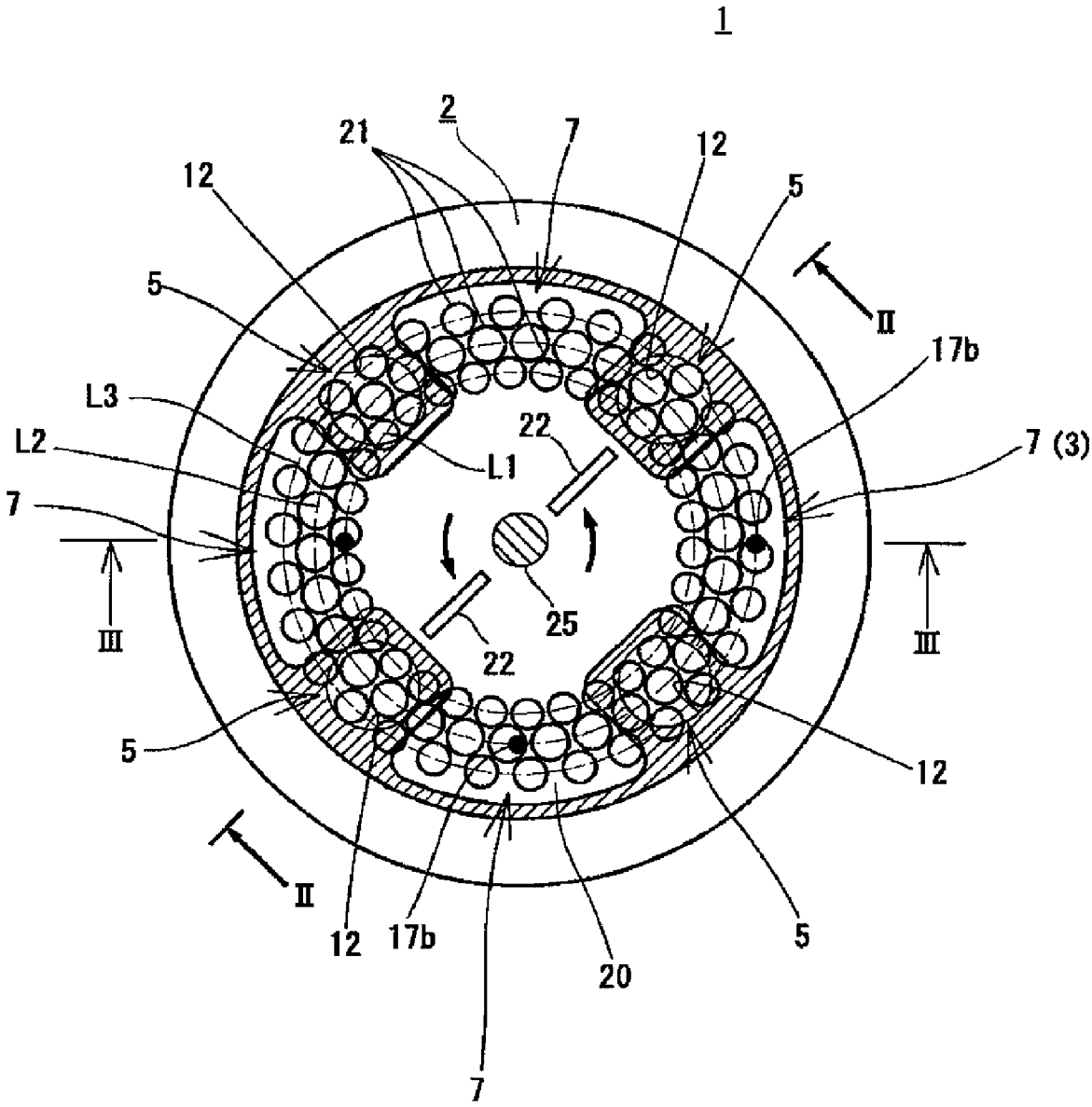
FIG. 1 is a top perspective view of an apparatus for supplying a constant amount of abrasives according to the present invention.
Figure 2:
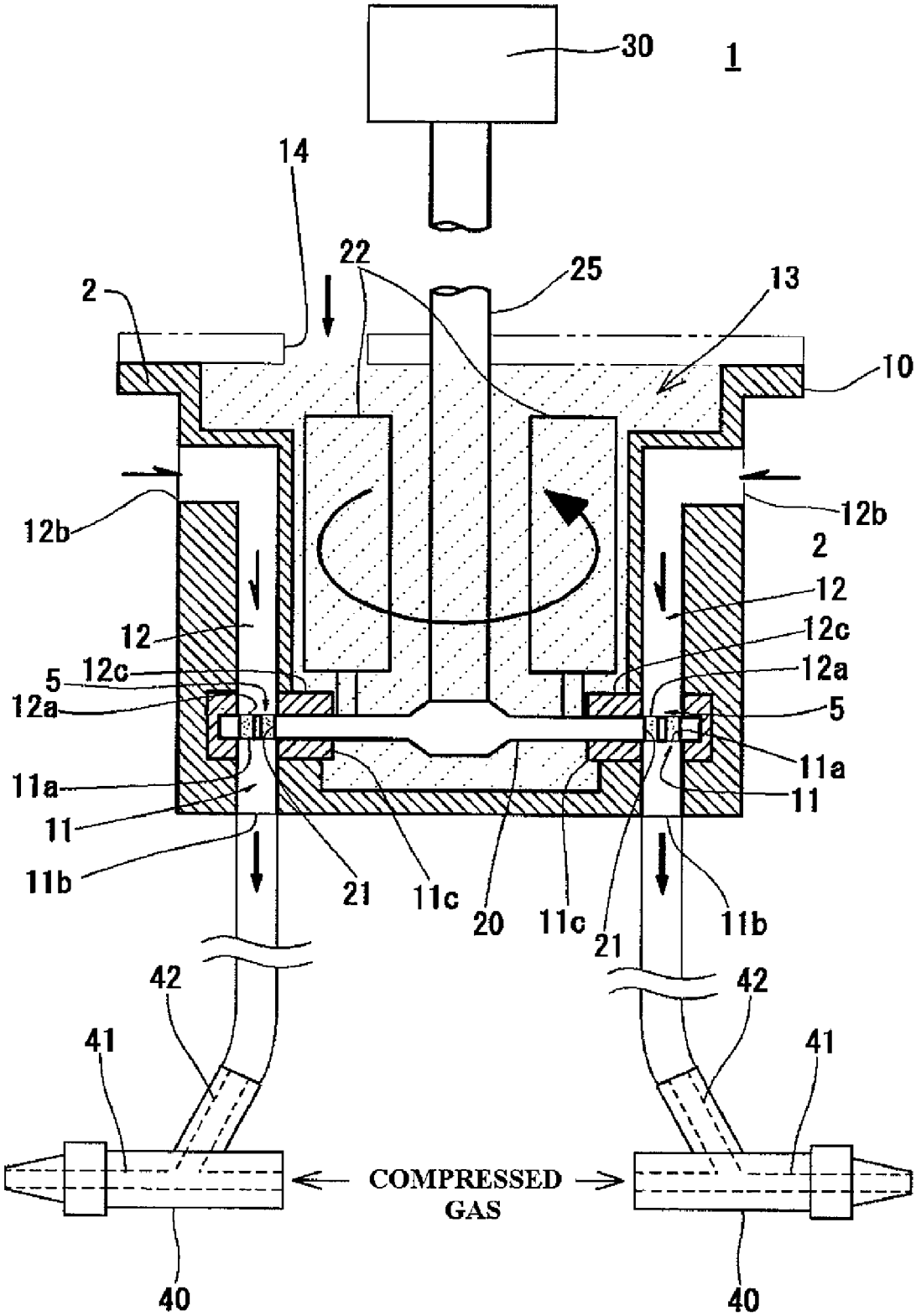
FIG. 2 is a cross-sectional schematic diagram taken along a line II-II of FIG. 1, illustrating the structure of an apparatus of the present invention for a suction blasting machine.
Figure 3:
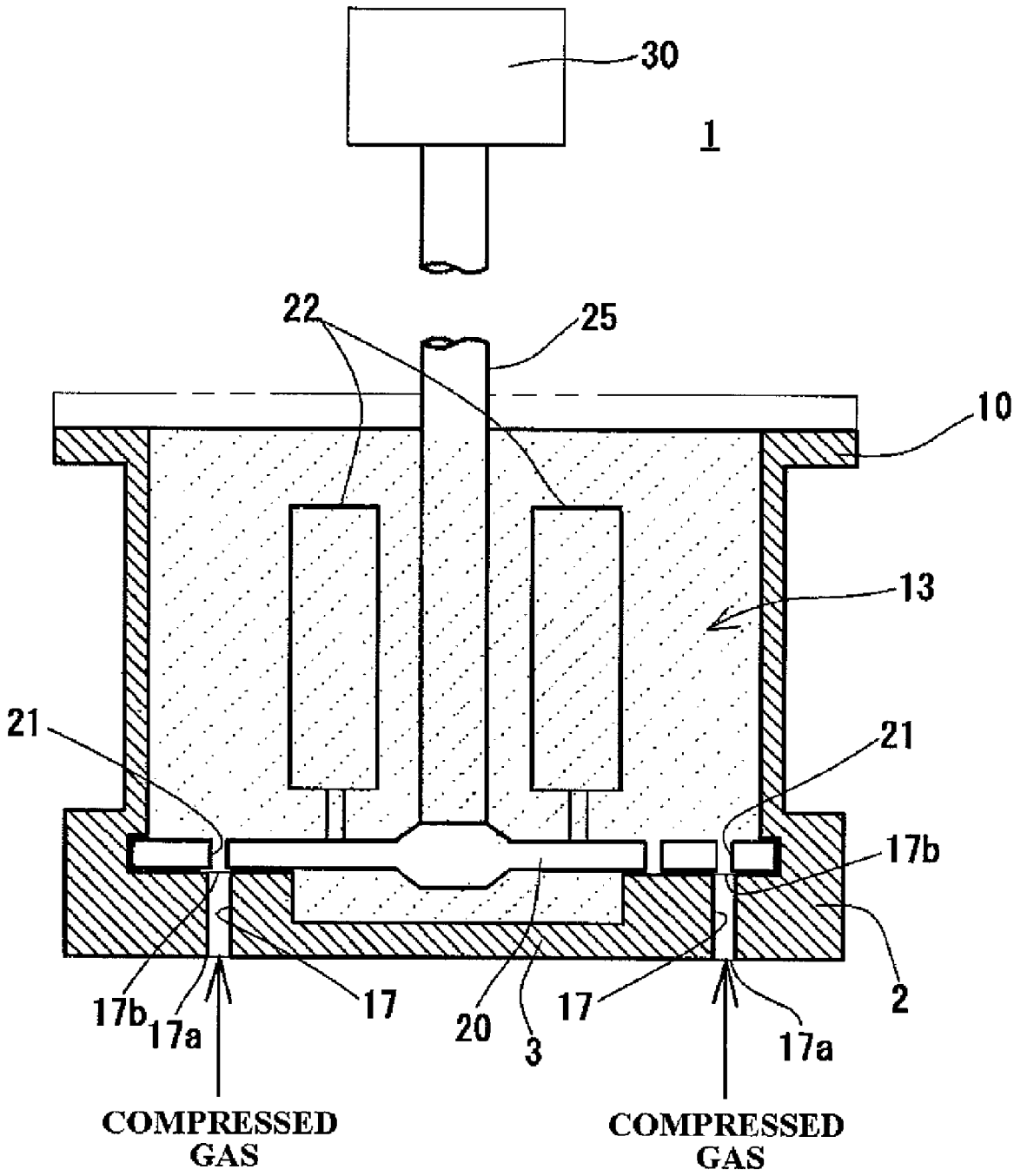
FIG. 3 is a cross-sectional schematic diagram taken along a line III-III of FIG. 1, illustrating the structure of an apparatus of the present invention for a suction blasting machine.

FIGS. 1 to 3 show an apparatus 1 of the present invention applicable to a suction blasting machine.

The apparatus 1 of the present invention includes an abrasive tank 10 that reserves the abrasives; an abrasive transport path 11 that are provided in a casing 2 of this abrasive tank 10 and transport the abrasives to blasting guns 40 of a blasting machine; supply channels 12 each having an opening at the other end 12*a* thereof facing an opening at one end 11*a* of the corresponding transport path 11 and introduce air flow for transporting the abrasives to the corresponding transport path 11; and a rotating disc 20 that measures the amount of the abrasives and sends a constant amount of the abrasives per unit time to each of the transport paths 11 through a space at an abrasive retrieve section 5 formed between the opening at the one end 11*a*of each transport path 11 and the opening at the other end 12*a* of the corresponding supply channel 12.

The apparatus 1 of this embodiment is constructed, for example, so as to provide four sets of the transport paths 11 and the supply channels 12 disposed at constant rotation-angle intervals along the rotation direction of the disc 20, thereby simultaneously supplying a constant amount of the abrasives to the blasting guns 40 disposed at four locations through each of the transport paths 11 (refer to FIG. 1).

The number of blasting guns 40 which supply the abrasives using one apparatus 1 of the present invention is not limited to the number in the embodiment shown but can be changed depending on the size of the disc 20, the number of locations at which the transport paths 11 and the supply channels 12 are provided, and so forth.

Rotating Disc

The rotating disc 20 is provided so as to be rotatable in the horizontal direction and is entirely embedded in the abrasives stored in the abrasive tank 10 described below. This disc 20 has through-holes formed in the thickness direction thereof and arranged at predetermined intervals in the circumferential direction. These through-holes function as measuring holes 21 for measuring the amount of transported the abrasives.

The sum of the capacities of the measuring holes 21 passing through the above-described retrieve sections 5 can be made constant at a predetermined rotation angle of the disc 20. For example, the measuring holes 21 formed so as to have the same capacity are arranged in the circumferential direction of the above-described disc. Thereby, the same amount of the abrasives can be collected in each of the measuring holes 21. Therefore, when the rotational speed of the disc 20 is constant, the abrasives collected in each of the measuring holes 21 can be transported to the transport paths 11 at a constant repeating speed. This ensures that the amount of the abrasives to be ejected from the blasting guns 40 becomes constant.

Although, in the embodiment shown in FIG. 1, three lines L1 to L3 are concentrically arranged on the disc 20 to form these measuring holes 21, one line, two lines, or four or more lines of the measuring holes 21 can be provided. When a plurality of lines of the measuring holes 21 are provided in this manner, different lines L1 to L3 of measuring holes 21 may have different diameters (capacities). In the embodiment shown in the figure, the center line (L2) of measuring holes 21 has larger diameters than those of the other lines L1 and L3 of the measuring holes 21.

A shaft 25 which penetrates the casing 2 of the tank 10 at the top plate portion (or the bottom plate portion) of the casing of the tank 10 is fastened at the center of the disc 20 formed as described above. With this structure, the disc 20 rotates at a predetermined speed in the horizontal direction in the tank 10, accompanied with a rotation of the shaft 25 which is driven by rotation means such as a motor 30 described below.

Furthermore, stirring vanes 22 preferably extending upward are provided on the top surface of the disc 20 so that the abrasives disposed above the disc 20 can be stirred with these stirring vanes 22 when the disc 20 rotates.

Although these stirring vanes 22 according to the embodiment shown in the figure are made in a plate shape, the shape of the stirring vane 22 is not limited only to a plate shape; the stirring vane 22 can be made in any other shape such as a cylindrical rod shape, as long as the abrasives disposed above the disc 20 can be stirred thereby.

Although a total of two stirring vanes are provided according to this embodiment, these stirring vanes 22 being symmetrically at 180° intervals, two or more stirring vanes 22 may be provided.

Abrasive Tank

The abrasive tank 10 in which the above-described disc 20 is housed contains the disc 20 so as to be rotatable in the casing 2 thereof and a reservoir space 13 in which the abrasives to be supplied to the blasting guns 40 is stored.

In the reservoir space 13 of this tank 10, the transport paths 11 communicating with the blasting guns described below are disposed at locations not interfering with the above-described stirring vanes 22 provided on the disc 20 such that the opening at the one end 11*a* of each transport path 11 faces the measuring holes 21 so as to be close to or in contact with the disc 20.

In the apparatus 1 of the present invention according to this embodiment that can simultaneously supply the abrasives to the four blasting guns 40 as described above, the transport paths 11 are also provided at four locations, and the openings at the ends 11*a* of the transport paths 11 are provided along the rotation direction of the disc at constant angular intervals (90°).

The opening at the other end 12*a* of each supply channel 12 is disposed on the other side of the disk, opposite the opening at the one end 11*a* of the corresponding transport path 11 so as to be close to or in contact with a surface of the disc 20 (the top surface of the disc 20 in the example shown), i.e., the surface remotes from the surface (the bottom surface of the disc 20 in the example shown) where the opening at the one end 11*a* of this corresponding transport path 11 is disposed so as to be close to or in contact therewith. Thereby, the retrieve section 5 is formed between the opening at the one end 11*a* of each transport path 11 and the opening at the other end 12*a* of the corresponding supply channel 12, so that the disc 20 passes through the spaces of these retrieve sections 5 as it rotates.

The one end 12*b* of each supply channel 12 is opened at a position where air can be introduced when negative pressure occurs in the corresponding transport path 11. In this embodiment, the interior of each transport path 11 is opened to the atmosphere outside the casing of the tank 10 through a side surface of the casing 2 of the tank 10.

The one end 12*b* of each of these supply channels 12 can be opened at any position as long as air can be introduced into the supply channel 12. For example, an opening may be provided at a location higher than an upper limit of the abrasives-filling position in the casing 2 of the tank 10.

Around the peripheral edge of the opening at the one end 11*a* of each transport path 11 and the peripheral edge of the opening at the other end 12*a* of each supply channel 12, flanges 11*c* and 12*c* that protrude in the outer circumferential direction from the surrounding edges of the openings may be provided, so that these flanges 11*c*, 12*c* may be slidably in contact with the top and bottom surfaces of the disc 20, with a space therebetween that allows the disc to rotate.

These flanges 11*c*, 12*c* are effective particularly when the diameters of the measuring holes 21 formed on the disc 20 are larger than the thickness of the walls of the transport paths 11 and the supply channels 12, for example, if the transport paths 11 and the supply channels 12 are formed of pipes. More specifically, when the measuring holes 21 pass between the wall of each transport path 11 and the wall of the corresponding supply channel 12, the transport path 11 can be prevented from directly communicating with the space in the tank 10 through the measuring holes 21. Also, when the disc 20 passes between the flanges 11*c* and 12*c*, the abrasives spilling from the openings above and below the measuring holes 21 formed on the disc 20 is removed so that accurately measured amounts of the abrasives are introduced between the opening at the one end 11*a* of the transport path 11 and the opening at the other end 12*a* of the supply channel 12.

In the embodiment shown in the figure, the flange 11*c* provided around the opening at the one end 11*a* of the transport path 11 and the flange 12*c* provided around the opening at the other end 12*a* of the supply channel 12 are linked to each other at the outer circumference of the disc 20 so as to have an angular U shape in cross-section (FIG. 2). The two flanges 11*c* and 12*c*, however, need not be linked to each other; that is, they may be separated from each other, one above and the other below.

As described above, filling of the measuring holes 21 with the abrasives that are retrieved when passing through the retrieve sections 5 is carried out from when the disc 20 has passed through one of the retrieve sections 5 until when it reaches the next retrieve section 5. To this end, an abrasive filling section 7 where the measuring holes 21 are filled with the abrasives, is formed between the retrieve sections 5 at two adjacent locations along the direction of rotation of the disc 20 (refer to FIG. 1).

In order to smoothly fill the measuring holes 21 with the abrasives at these filling sections 7, according to the apparatus 1 of the present invention, a compressed gas is ejected to the abrasives disposed above the disc 20, particularly to the abrasives disposed above the measuring holes 21 formed on the disc 20, at the filling sections 7 in the tank 10, for example, to remove the aggregation of the abrasives by stirring the abrasives in this area. In this manner, the fluidity of the abrasives flowing into the measuring holes 21 can be recovered.

This ejection of compressed gas may be performed at any position in any manner, as long as the abrasives located at the filling sections 7 can be stirred to recover the fluidity of the abrasives whose fluidity has been decreased due to, for example, aggregation. More specifically, a compressed gas may be ejected into the tank 10 through introduction paths 17 which penetrate the side wall of the casing 2 of the tank 10 and opened in the casing of the tank 10.

This embodiment provides a structure in which the introduction paths 17 for introducing a compressed gas are formed at the filling sections 7 in the tank 10 such that the introduction paths 17 penetrate the bottom surface of the casing 2 of the tank 10, a compressed-gas supply source (not shown) is made to communicate with one end 17*a* of each introduction path 17 provided outside the casing of the tank 10 so that a compressed gas (e.g., compressed air) is introduced and the compressed gas is intermittently ejected from the other end 17*b* having an opening that faces the measuring holes 21 formed on the disc 20 in the tank 10, thereby stirring the abrasives above the measuring holes 21 of the disc 20.

Referring again to FIG. 1, in this embodiment where the filling sections 7 are provided at four locations between the retrieve sections 5 provided at constant rotation-angle intervals, i.e., 90° of the disc 20, these introduction paths 17 may be provided one for each filling section 7 or two or more for each filling section 7. Not all filling sections 7 need to be provided with an introduction path 17. In the embodiment shown in the figure, the introduction paths 17 are provided only for three of the four locations at which the filling sections 7 are disposed.

When a plurality of lines of the measuring holes 21 are to be formed on the disc 20, it is preferable that an introduction path 17 be provided for each line (L1, L2, and L3 for this embodiment) of the measuring holes 21. In the embodiment shown in the figure, the introduction path 17 provided at the filling section 7 shown on the left side of FIG. 1 is formed at the location corresponding to the innermost circumferential measuring holes 21 (line L1), the introduction path 17 provided at the filling section 7 shown on the lower side of the figure is formed at the location corresponding to the center line L2 of the measuring holes 21, and the introduction path 17 provided at the filling section 7 shown on the right side of the figure is formed at the location corresponding to the line L3 of the outermost circumferential measuring holes 21. With the above-described structure, a compressed gas is ejected to the abrasives in the measuring holes 21 on any of the lines L1 to L3.

The introduction paths 17 constructed as described above are each made to communicate with the compressed-gas supply source (not shown) outside the casing 2 of the tank 10, and a compressed gas supplied from this compressed-gas supply source is ejected through each of the introduction paths 17 to the abrasives disposed at the filling section 7 in the tank 10.

Opening/closing means, such as an electromagnetic valve or a ball valve, is provided between this compressed-air supply source and each of the introduction paths 17 so that ejection of compressed gas through each of the introduction paths 17 can be intermittently performed at shorter intervals.

Referring to FIGS. 2 and 3, reference numeral 14 denotes an abrasive supply port, which is an opening through which the abrasives are introduced into the tank 10. The abrasive supply port communicates with, for example, the bottom end of the recovery tank (not shown) for recovering the abrasives ejected from the blasting guns 40 to introduce the abrasives recovered in the recovery tank in the tank 10.

The tank 10 always stores a sufficient amount of the abrasives to allow the disc 20, including the stirring vanes 22, to be entirely embedded with the abrasives. Preferably, a constant amount of the abrasives is always stored therein.

Although not shown, a structure for ensuring that a constant amount of the abrasives is always stored in the tank 10 as described above is realized, for example, by extending the bottom end of the supply port 14 downward into the tank 10 and arranging the opening of this supply port as the upper limit position of the reserved abrasives.

With this structure, when the abrasives introduced into the tank 10 is accumulated at the bottom-end position of the abrasives supply port 14, the bottom end of the supply port 14 is blocked by this abrasives, thereby preventing any further abrasives from falling. Therefore, even without control of the introduction of the abrasives into the tank 10, if the upper-limit position of the abrasives stored in the tank 10 falls as a result of the abrasives being supplied to the blasting guns 40, the same amount of the abrasives as that equivalent to this fall is introduced through the supply port 14, thus always keeping the amount of the abrasives in the tank 10 constant.

A structure that keeps the amount of the abrasives in the tank 10 constant is not limited to the above-described structure where the bottom end of the supply port 14 is extended. Instead, a sensor for detecting the upper-limit position of the abrasives reserved in the reservoir space of the tank 10 may be provided so that, for example, an open/close valve (not shown) may be controlled according to a detection signal of this sensor to allow a desired amount of the abrasives to fall into the tank 10.

Rotation Means

In this embodiment, rotation means for rotating the disc 20 is realized by the electric motor 30 disposed above the casing 2 of the tank 10. The top end of the shaft 25 penetrating the casing of the tank 10 at the top plate thereof is linked with this motor 30, and further, the disc 20 is linked with the bottom end of this shaft 25. Thereby, the disc 20 in the tank 10 can be rotated through the rotation of this motor 30.

For this motor 30, various types of motors can be used as long as they can control the rotational speed of the disc 20. For example, a DC motor may be used to change the rotational speed according to a change in input voltage. Alternatively, with a three-phase AC motor, as well as an inverter, the rotational speed may be controlled by changing the frequency of an input electrical current.

The rotational speed of the disc 20 is controlled by controlling the rotational speed of the motor 30 as described above to change the number of measuring holes 21 that pass through the above-described retrieve sections 5 within a predetermined period of time. Thus, the amount of the abrasives transported in these measuring holes is adjusted. As a result, the amount of the abrasive supplied to the blasting guns 40 can be controlled accurately.

Operating Procedures and Effects

In the apparatus 1 of the present invention with the above-described structure, a compressed-air flow channel for the blasting gun flowing a high-pressure compressed gas, such as compressed air therein is merged with each of the transport paths 11 via the other end 11*b* of the transport path 11.

In the embodiment shown in FIGS. 2 and 3, the blasting guns 40 each having therein a compressed-air flow channel 41 and a branch channel 42 branching off this flow channel 41 are used. Furthermore, the transport path 11 communicates with the branch channel 42 of each blasting gun 40 via an opening 11*b* at the other end of the transport path 11.

The above-described motor 30 is preferably designed so as to rotate at the preset rotational speed only when compressed air is introduced into the blasting guns 40. Thereby, the disc 20 can be prevented from rotating while no abrasive is ejected. As a result, no abrasives falls and accumulates in each transport path 11, and therefore, a large amount of the abrasives can be prevented from being ejected when blasting work is started.

As described above, with each of the transport paths 11 of the apparatus 1 of the present invention communicating with the branch channel 42 of the corresponding blasting gun 40 via the opening 11*b* at the other end of the transport path 11, when compressed air from the compressed-air supply source (not shown) is introduced from the rear end of the corresponding blasting gun 40 into the supply channel 41, this introduction of the compressed air causes negative pressure in the transport path 11 via the branch channel 42, the external air is introduced into the transport path 11, and further, the external air introduced from the corresponding supply channel 12 whose opening at the one end 12*b* thereof opens outside the casing 2 of the tank 10 passes through the measuring holes 21 of the disc 20 disposed at the retrieve section 5.

With the help of a transport air flow passing through these measuring holes 21, the abrasives collected in the measuring holes 21 is sucked from the measuring holes 21 and mixed with the transport air flow into the transport paths 11. The abrasives is then combined with compressed air from the compressed-air supply source in the flow channel 41 provided in each blasting gun 40 and is then ejected from the nozzle at the front end of the blasting gun 40.

In this manner, the abrasives accumulated in the measuring holes 21 at the retrieve sections 5 are retrieved. As the disc 20 rotates, the measuring holes 21 that have become empty move from the retrieve sections 5 to the filling sections 7 adjacent to these retrieve sections 5, and in the filling sections 7, the abrasives stored in the tank 10 falls and accumulate in the measuring holes 21.

As described above, these filling sections 7 are provided with the introduction paths 17 that penetrate the casing 2 of the tank 10 at the bottom surface thereof, and a compressed gas is intermittently ejected to the reservoir space 13 of the tank 10 from the opening at the other end 17*b* of each of the introduction paths 17, i.e., the opening that faces the abrasives disposed above the measuring holes 21 of the disc 20, to stir the abrasives, thereby recovering the fluidity of the abrasives whose fluidity has decreased due to, for example, aggregation.

The disc 20 is provided in the tank 10 so as to be rotatable in the horizontal direction and has thereon the measuring holes 21 extending in the vertical direction so as to penetrate the disc 20 itself through the thickness. Because of this, the abrasives whose fluidity has been recovered can smoothly flow in these measuring holes 21.

Furthermore, with the stirring vanes 22 extending upward from the top surface of the disc 20, the abrasives is forcibly stirred by the stirring vanes 22 in addition to the stirring by the compressed gas introduced through the introduction paths 17. For this reason, if the abrasives should be hardened so seriously that ejection by a compressed gas alone cannot recover the fluidity of the abrasives, the abrasives is stirred and loosened by the stirring vanes 22 to allow the abrasives to properly flow into the measuring holes 21.

This disc 20 is entirely embedded with the abrasives stored in the reservoir space 13 of the tank 10. Because of this, even if the abrasives that has entered in the measuring holes 21 flows out of the measuring holes 21 in the course of the rotation of the disc 20 in the abrasives, the abrasives disposed around the disc 20 enters the measuring holes 21 to compensate for the abrasives that has flowed out, thus ensuring that the measuring holes 21 are always filled with a constant amount of the abrasives.

In addition, unlike a conventional apparatus including a drum and a disc that are partly exposed from the abrasives rather than being completely embedded therein, the amount of the abrasives supplied by the disc 20, which is embedded in the abrasives in this way, is not affected by a change in the amount of the abrasives in the tank 10.

In this manner, the abrasives collected in the measuring holes 21 of the disc 20 moves as the disc 20 rotates so that the abrasives of the excess amount is removed at the clamping portion between the opening at one end 11*a* of each transport path 11 and the opening at the other end 12*a* of the corresponding supply channel 12. Consequently, only an amount of the abrasives equivalent to the capacity of the measuring holes 21 is transported between the opening at one end 11*a* of each transport path 11 and the opening at the other end 12*a* of the corresponding supply channel 12.

The abrasives transported in this manner are introduced into the transport paths 11 along with the air flow passing through the measuring holes 21. Unlike a bottomed measuring groove or measuring hole employed in the conventional art, therefore, all of the abrasives can be transported to the transport paths 11 without causing any abrasives to remain in the measuring holes 21.

Thus, regarding the abrasives to be ejected from the blast guns 40, an accurate amount of the abrasives, measured with this disc 20, can be supplied to and ejected from the blasting guns 40.

As described above, with control means provided to ensure that a constant amount of the abrasives is always stored in the tank 10, when the abrasives in the tank 10 is ejected from the blasting guns 40 and decreased, the abrasives in an amount equivalent to this decrease is introduced into the tank 10 through the supply port 14 to exercise control such that the amount of the abrasives in the tank 10 is always constant.

As a result, there is no change in the density (degree of congestion of particles) of the stored abrasives due to a change in weight of the abrasives stored in the tank 10, and the amount of the supplied abrasives is prevented from changing as a result of such a change in density.

[Apparatus for Supplying a Constant Amount of the Abrasives for Use with a direct-pressure Blasting Machine]

Figure 4:
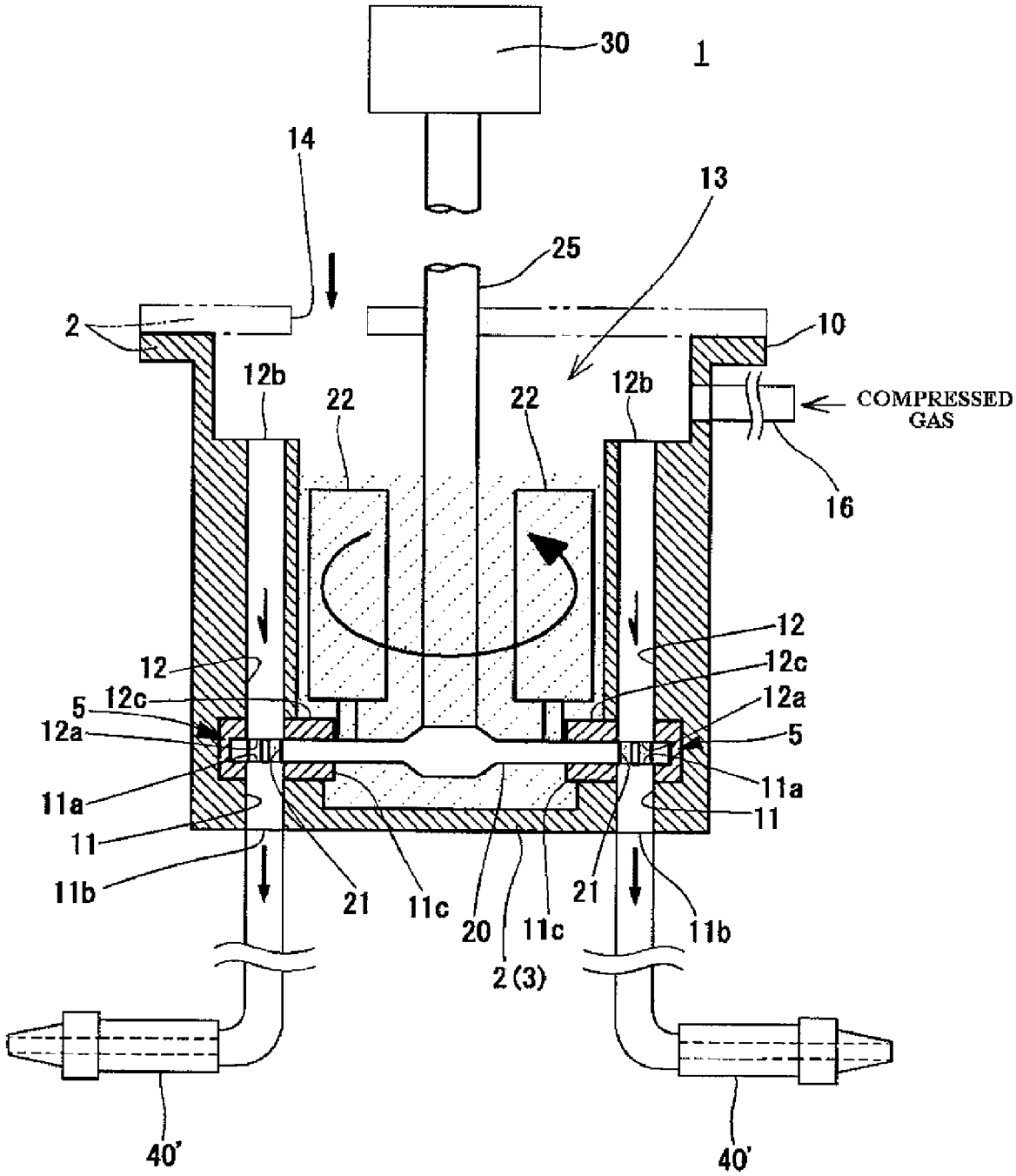
FIG. 4 is a cross-sectional schematic diagram taken along a line II-II of FIG. 1, illustrating the structure of an apparatus of the present invention for a direct-pressure blasting machine.
Figure 5:
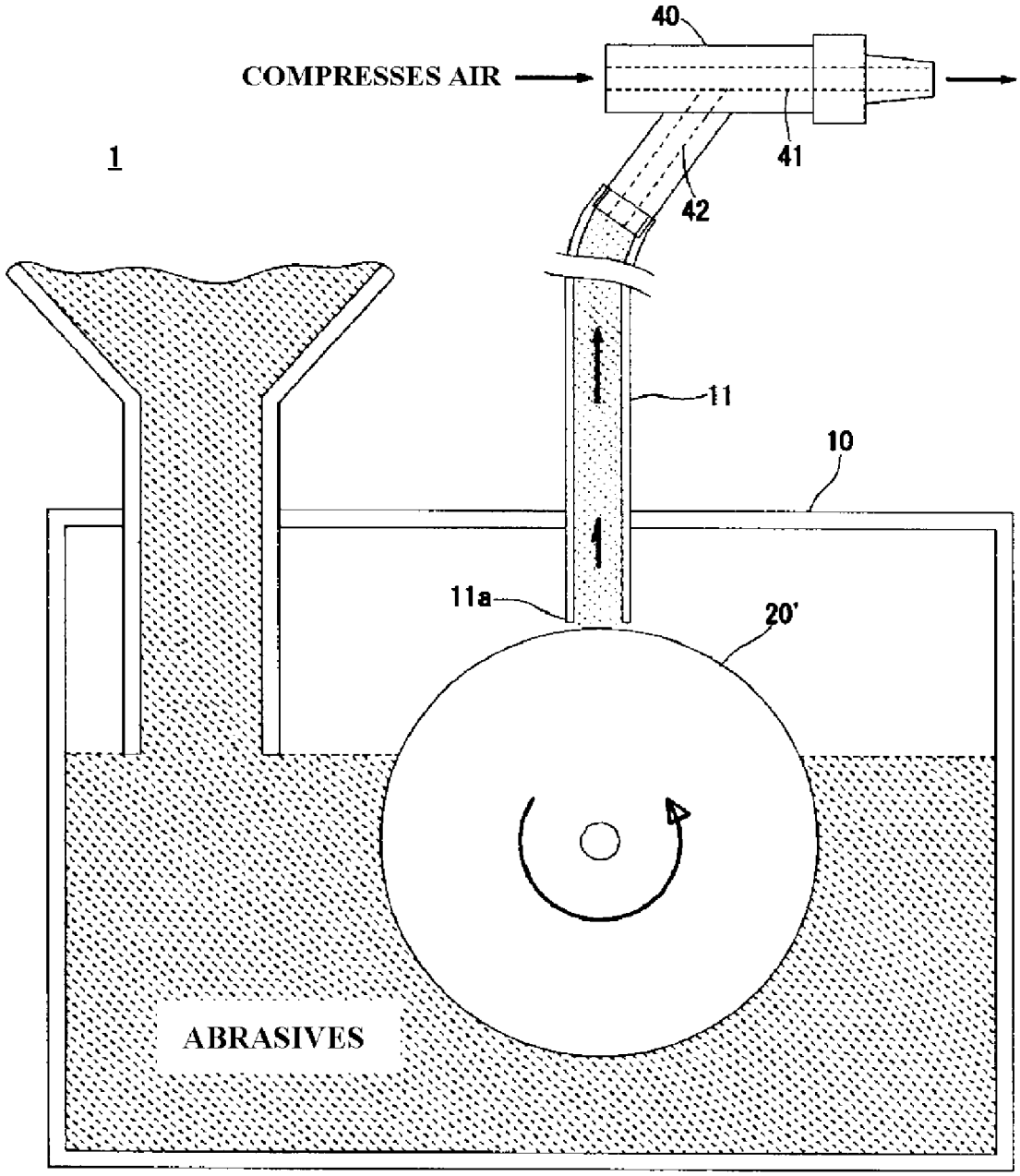
FIG. 5 is a schematic illustration (front elevational view) of a known apparatus for supplying a constant amount of the abrasives (suction type)
Figure 6:
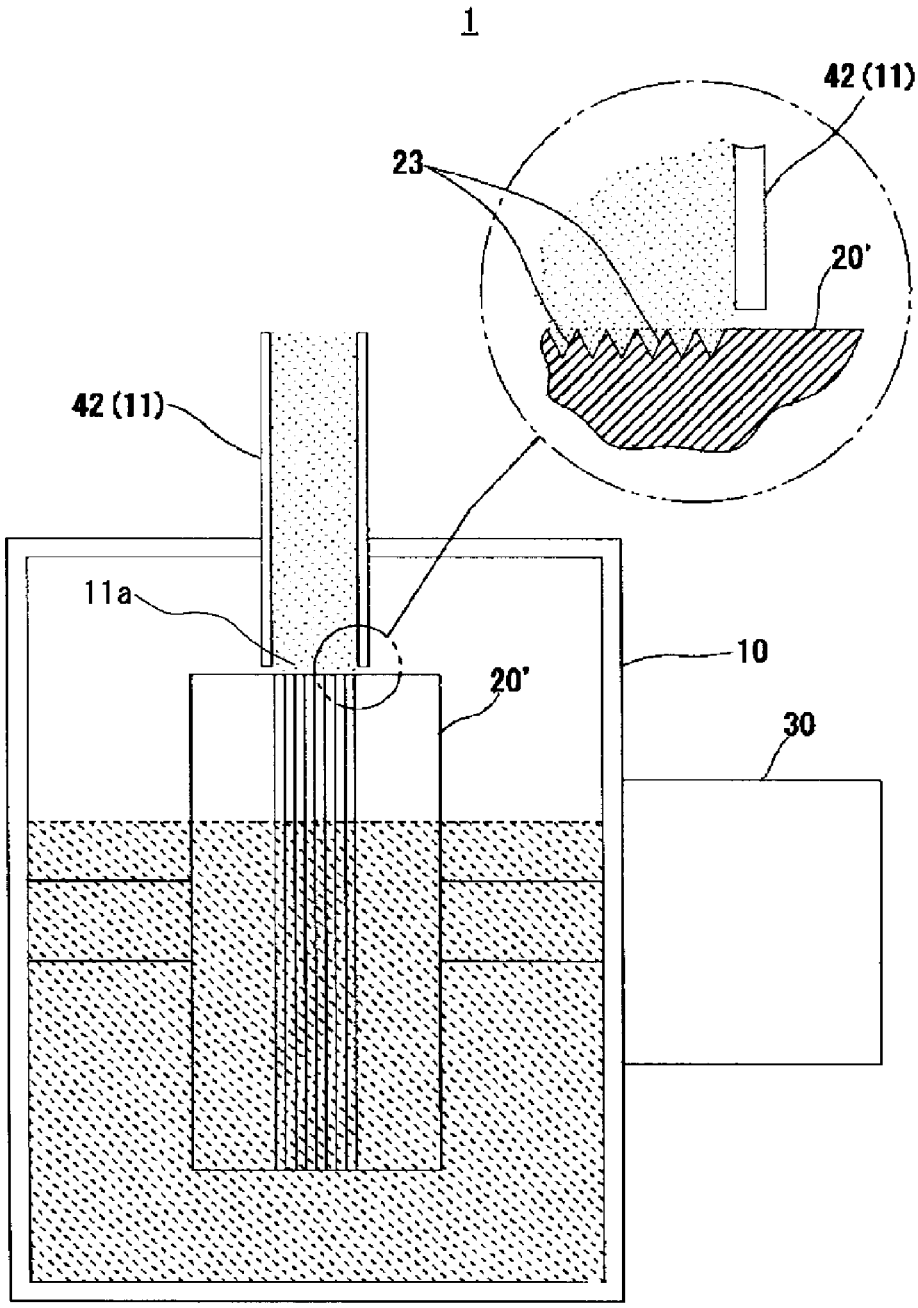
FIG. 6 is a right side view of FIG. 5.
Figure 7:
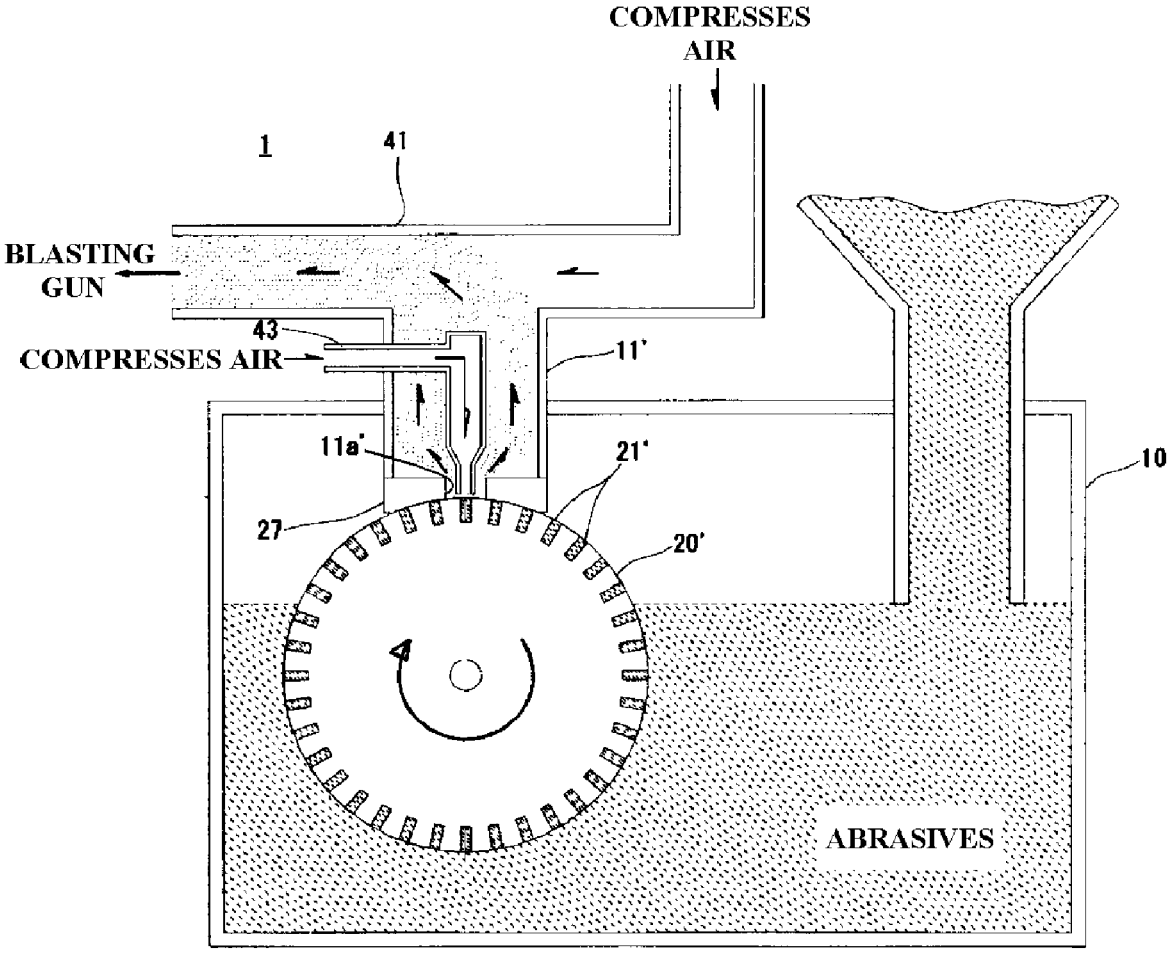
FIG. 7 is a schematic illustration of a known apparatus (direct pressure type).

An apparatus of the present invention applied to a direct-pressure blasting machine will now be described with reference to FIG. 4.

In the apparatus 1 of the present invention for use with a suction blasting machine described with reference to FIGS. 2 and 3, the air in each transport path 11 communicating with the corresponding branch channel 42 is sucked due to negative pressure generated in the branch channel 42 when compressed air is introduced into the compressed-air flow channel 41 provided in the corresponding blasting gun 40, and consequently, the abrasives in the measuring holes 21 facing the opening at one end 11*a* of the transport path 11 is sucked and transported to the corresponding blasting gun 40. On the other hand, in this embodiment, a compressed gas is blown into the measuring holes 21 from a side of the disc 20 remote from the surface close to the opening at one end 11*a* of each of the transport paths 11, and this compressed gas allows the abrasives in the measuring holes 21 to be transported to the corresponding blasting gun 40.

In order to blow a compressed gas into the measuring holes 21 formed on the disc 20 as described above, the compressed-gas supply source is made to communicate with the one end 12*b* of each of the supply channels 12 for transport air flow, a compressed gas discharged from the opening at the other end 12*a* of the supply channel 12 is blown into the measuring holes 21, and then the compressed gas mixed with the abrasives in the measuring holes 21 is introduced into the transport path 11.

The compressed-gas supply source may be made to communicate directly with the one end 12*b* of each supply channel 12 through, for example, a conduit. In this embodiment, however, the source is made to communicate with the one end 12*b* of the supply channels 12 through the reservoir space 13 formed in the tank 10 to temporarily store in the tank 10 a compressed gas introduced from the compressed-gas supply source, so that the compressed gas stored in this tank 10 is then sent to the supply channels 12.

In this embodiment, to allow a compressed gas to be introduced into the transport paths 11 as described above, not only is the tank 10 sealed hermetically but also it is made to communicate with a tank pressurized pipe 16 for introducing a compressed gas into this abrasive tank 10.

In the apparatus 1 of the present invention described with reference to FIG. 3, the one end 12*b* of each supply channel 12 communicating with the outside of the casing 2 of the tank 10 is made open above the upper limit position of the abrasives reserved in the tank 10, so that a compressed gas introduced into the tank 10 through the tank pressurized pipe 16 can be blown into the measuring holes 21 through the supply channel 12.

When the tank 10 is pressurized with a compressed gas as described above, the compressed gas to be introduced into the abrasive tank 10 through the introduction paths 17 formed on the bottom surface of the casing 2 of the abrasive tank 10 needs to have higher pressure than the pressure in the tank 10.

The other structures are the same as those of the apparatus 1 of the present invention described with reference to FIGS. 1 to 3.

In the apparatus 1 of the present invention constructed as described above, the opening at the other end 11*b* of each transport path 11 is made to communicate with a blasting gun 40' for a direct-pressure blasting machine.

In the example shown in the figure, this blasting gun 40' is designed to eject from the front end thereof a mixed fluid, composed of a compressed gas introduced through the rear end of the blasting gun 40' from the transport path 11 and the abrasives. Instead, it is possible to use known types of blasting guns with a structure allowing a mixed fluid, composed of a compressed gas and the abrasives, to be ejected.

With the above-described structure, the compressed gas in the tank is introduced into the supply channels 12 each having an opening at the one end 12*b* thereof in the tank 10, is discharged from the opening at the other end 12*a* of the supply channel 12, is blown into the measuring holes 21 provided on the disc 20 from the one end thereof is discharged from the other end together with the abrasives collected in these measuring holes 21, and is then introduced into the corresponding transport path 11 through the opening at the one end 11*a* of the transport path 11. Thereafter, the abrasives are transported into the blasting gun 40' together with the compressed air and ejected from the front end of the blasting gun 40'.

In this manner, the abrasives in the measuring holes 21 are ejected together with the compressed gas blown into the measuring holes 21, and all of the abrasives can be accurately transported to the blasting gun 40' without allowing any abrasives to remain in the measuring holes 21.

As with the apparatus 1 of the present invention applied to a suction blasting machine described with reference to FIGS. 2 and 3, the amount of the abrasives to be introduced into the blasting guns 40' can be controlled accurately by controlling the rotational speed of the disc 20.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. An apparatus for supplying a constant amount of abrasives to a blasting gun of a blasting machine that ejects a mixed fluid composed of a compressed gas and the abrasives supplied from an abrasive tank for storing the abrasives, comprising:

a supply channel for a transport air flow in a casing of the tank, the supply channel communicating with an external compressed-gas supply source;

a transport path for the abrasives, communicating with the supply channel, the transport path having one end thereof communicating with the supply channel and the other end thereof communicating with the blasting gun;

a rotating disc in the casing, wherein the rotating disc is entirely embedded within the abrasives stored in a space separated from the supply channel and the transport path; the rotating disc rotationally passes through an abrasive retrieve section defined as an opening formed between the supply channel and the transport path; and the rotating disc includes a plurality of measuring holes formed at regular intervals along a circumferential direction thereof such that the plurality of measuring holes pass through the disk in a thickness direction of the rotating disk, the plurality of measuring holes being disposed on a rotation orbit so as to allow the supply channel to communicate with the transport path through the retrieve section as the rotating disc rotates; and an introduction path for compressed gas passing through a bottom surface of the casing, wherein one of two ends of the introduction path communicates with the compressed-gas supply source outside the casing of the tank, and the other of said two ends of the introduction path opens in a rotation orbit direction of the measuring holes at a position except the retrieve section, which is a section including the transport path.

2. The apparatus for supplying a constant amount of abrasives according to claim 1, wherein the introduction path is provided so as to pass through a bottom surface of the tank, and the other end of the introduction path includes an opening that faces the measuring holes formed on the disc.

3. The apparatus for supplying a constant amount of abrasives according to claim 2, wherein a plurality of lines of the measuring holes which are formed vertically are disposed concentrically along a circumferential direction of the disc rotating in a horizontal direction, and a plurality of the introduction paths are provided so as to correspond to the locations of the lines, respectively.

4. The apparatus for supplying a constant amount of abrasives according to claim 3, wherein a plurality of sets of the transport paths and the supply channels are provided and the retrieve section is provided at along a rotation direction of the disc at constant angular intervals.

5. The apparatus for supplying a constant amount of abrasives according to claim 3, wherein a stirring vane for stirring the abrasives extends from a top surface of the disc.

6. The apparatus for supplying a constant amount of abrasives according to claim 2, wherein a plurality of sets of the transport paths and the supply channels are provided and the retrieve section is provided at along a rotation direction of the disc at constant angular intervals.

7. The apparatus for supplying a constant amount of abrasives according to claim 1, wherein a plurality of sets of the transport paths and the supply channels are provided and the retrieve section is provided along a rotation direction of the disc at constant angular intervals.

8. The apparatus for supplying a constant amount of abrasives according to claim 7, wherein a stirring vane for stirring the abrasives extends from a top surface of the disc.

9. The apparatus for supplying a constant amount of abrasives according to claim 1, wherein a stirring vane for stirring the abrasives extends from a top surface of the disc.

10. The apparatus for supplying a constant amount of abrasives according to claim 1, wherein the blasting machine is a suction blasting machine, and one of two ends of the supply channel has an opening outside the tank.

11. The apparatus for supplying a constant amount of abrasives according to claim 1, wherein the blasting machine is a direct-pressure blasting machine, and one of two ends of the supply channel is made to communicate with the compressed-gas supply source.

12. The apparatus for supplying a constant amount of abrasives according to claim 11, wherein the abrasive tank can be hermetically made to communicate with the compressed-gas supply source, and the one of two ends of the supply channel opens in the tank at a position higher than an upper limit of the abrasives-filling position.

13. The apparatus for supplying a constant amount of abrasives according to claim 1, wherein a flange slidably in contact with the disc is provided at an opening at the one end of the transport path and an opening at other one of two ends of the supply channel.

* * * * *